US005141041A

United States Patent [19]

Katz et al.

[11] Patent Number: 5,141,041

[45] Date of Patent: Aug. 25, 1992

[54] STEPPED MULTI-CELLULAR WINDOW SHADE

[75] Inventors: Alan J. Katz, Schenectady; Thomas J. Marusak, Loudonville; John T. Schnebly, Wynantskill, all of N.Y.

[73] Assignee: Comfortex Corporation, Cohoes, N.Y.

[21] Appl. No.: 763,090

[22] Filed: Sep. 20, 1991

[51] Int. Cl.[5] ..... E06B 9/34

[52] U.S. Cl. ..... 160/84.1

[58] Field of Search ..... 160/84.1, 172, 279; 52/806; 156/197; 428/116, 118, 181, 188

[56] References Cited

U.S. PATENT DOCUMENTS

| | | | |
|---|---|---|---|
| 3,552,901 | 1/1971 | Johnson et al. | 160/84. 1 X |
| 4,307,768 | 12/1981 | Anderson | 160/84.1 |
| 4,625,786 | 12/1986 | Carter et al. | 160/268.1 X |
| 4,647,488 | 3/1987 | Schnebly et al. | 160/84.1 X |
| 4,665,964 | 5/1987 | Zommers | 160/84.1 |
| 4,739,816 | 4/1988 | Dodich et al. | 160/172 X |
| 4,807,686 | 2/1989 | Schnebly et al. | 160/84.1 |
| 4,917,167 | 4/1990 | Voss et al. | 160/84.1 |

*Primary Examiner*—David M. Purol

*Attorney, Agent, or Firm*—Dykema Gossett

[57] ABSTRACT

The present invention is an improved multi-cellular shade which is adapted to be mounted within a window and in particular a non-vertical window. The shade has a cut away portion on each of its end. This cut away portion is defined by a stepped section that terminates in an angled section as viewed from the rear side toward the front side of the shade. The stepped section is further defined by two substantially perpendicular walls, one wall being generally perpendicular to the faces of the shade and the second wall being generally parallel to the faces. The second or parallel wall terminates in the angled portion, and the angled portion is at a generally obtuse angle to the second wall. Preferably, the cutaway end of the shade is configured to be recieved with in a C-shaped channel. The channel has a lower leg for supporting the shade and an upper leg having a track for receipt of a drive mechanism to expand and retract the shade, and a flange which extends over a portion of the shade to prevent bowing of the shade. By such disclsoed apparatus, interferences that cause binding are avoided while structural strength of the cellular material is retained.

15 Claims, 1 Drawing Sheet

10
11
12
14
16
18
20
22
24
25
26
28
30
34
36
38
40
2

11
12
14
21
22
26
32
33
34
36
38
40
42
44
46
48

32
40
42
46
48
52
54

40
42
44
46
48
50

STEPPED MULTI-CELLULAR WINDOW SHADE

BACKGROUND

The present invention relates to window shades and more particularly to multi-cellular window shades with retracting mechanisms that are hidden from view.

Multi cellular shades have become a desirable window treatment, particularly with modern construction that emphasizes large expanses of windows. The shades provide insulation for the windows while simultaneously providing a very attractive window covering that can be expanded and retracted as desired.

To maintain the overall appearance of the shade it is necessary to conceal the retracting mechanism from view. This is typically accomplished by enclosing the retracting mechanism in the multi cellular shade. Since the shade is multi-cellular, the retracting mechanism can be mounted in holes or slots formed along the outer edges of the shade without being visible.

Examples of concealed retracting mechanisms utilized in multi cellular shades are disclosed in U.S. Pat. No. 4,675,060 ('060) issued on Jun. 23, 1987 and in U.S. Pat. No. 4,647,488 ('488) issued on Mar. 3, 1987. As illustrated in the '060 patent, cords that form part of the retracting mechanism are threaded through holes that are drilled into the shade and into the header and footer of the shade assembly. Because of the cellular construction, the cords are hidden from view. Therefore, the shade can be expanded to its full length without the cords being visible. In addition, the '488 patent describes notching the cellular structure in the structure's center to locate a supporting member that allows the shade to be supported in non vertical applications by the contact of one side of the notch to the supporting member.

In PCT Application No. W090/06845 ('845), published on Jun. 28, 1990, an alternative design is shown which uses slots cut into the side edges of the shade for receipt of the retracting cord or other retracting means. As stated in the patent application, the design allows the inclusion of actuating and guiding means in the space between the structure's faces. This space can be pierced or slotted, or truncated in order to provide for any of the known actuating and guide means, without danger of binding.

Both of these shade designs for hiding the retracting mechanism have disadvantages. First, each has the potential for the shade to bind when it is being retracted or expanded. This can cause the shade to expand or retract unevenly, which is unsightly. It can also lead to wear of and possible damage to the shade. Still further, the retracting mechanism may be damaged. This is a particular problem when automated retracting mechanisms are used. In these applications, the shade must be supported in the window which is typically accomplished by the retracting means supporting the shade. Since the automated units rely upon some type of mechanical interaction between the driving means and the shade, binding of the shade could lead to misalignment of the mechanism and possible jamming of the retracting mechanism.

The above problems are more acute when the above designs are used in non vertical applications, such as for example in skylights. The shade disclosed in the '060 patent could have binding problems between the shade notch and the support member in non vertical applications. This is due to the requirement that the notch be no wider than the area between bond lines of the cellular structure. If the track is not exactly parallel to the notch, binding will occur.

In the '845 disclosure, the shade is supported by the track of the retracting mechanism as the shade is expanding and retracting. In these situations, the width of the slotting or notching of the shade and the thickness of the guidance means must be matched so that binding of the structure may be made to occur at some definable degree of expansion. However, this does require greater precision in manufacturing the shade due to the need for matching. Further, in these situations, there is the possibility that the shade will not be stiff enough at the areas contacting the shade, again resulting in an unsightly shade and possible damage to the shade.

The potential disadvantages were partially recognized in the '845 application. In the disclosure there is discussion about intended binding, although controlled, to aid in the expansion of the shade. (As should be appreciated by those of ordinary skill in this art, the amount of control can be difficult to achieve in many circumstances.) As further discussed in the application, "should certain installations (essentially horizontal) require maximum support within the shade, the truncated version of the slots 114 would most likely be used with the bonding line 112 structure used as the principal supporting surface contacting the guidance tongue 118." It further suggests that "additional coatings on the margins 115 may be applied during the adhesive strip application process. This would afford the notch 114 with a stiffened periphery and allow it to acquire the desired rigid character of the stiffened bond line 112." As should be appreciated, the additional gluing adds to manufacturing costs as well as the added cost to match the notch size to the track size.

SUMMARY OF THE INVENTION

The present invention overcomes the above disadvantages by providing an improved multi cellular shade that hides the retracting mechanism without having the disadvantages found in the above examples. The present invention is particularly suited for use in non vertical window applications and even more advantageous when used in conjunction with automated retracting mechanisms.

The improved multi cellular shade of the present invention is adapted to be mounted within a window frame, such as for example, in a skylight, and is adapted to be expanded and retracted within the skylight by a retracting means. The shade includes a front face and a rear face with the rear face being adjacent the window and the front face facing the interior of the room.

At least one side of the shade is cut away for receipt of the retracting means and in the preferred embodiment, the top portion of a C-shaped channel which encloses the side of the shade. The cut away portion of the shade extends both laterally and longitudinally with respect to the shade. The lateral extent of the cut away portion of the shade is greatest at the rear of the shade and decreases in dimension as it nears the front of the shade. This results in the front face of the shade being substantially uncut and equal to its normal width. In this way, the front face of the shade can rest upon a mounting flange and support the shade in the window. In this way, the front face of the shade can rest upon a mounting flange and support the shade in the window, which greatly reduces binding problems and allows for conveniently sized fasteners to attach the C-shaped channel to the window frame.

The cut away portion is defined by a stepped section that terminates in an angled section as viewed from the rear side toward the front side of the shade. The stepped section is defined by two substantially perpendicular planes that are formed by making a first cut into the shade that is perpendicular to the front and rear faces of the shade and a second cut that is parallel to the faces. This second cut terminates in the angled portion which is preferably at an obtuse angle to the second cut and terminates at the front face of the shade. The depth of the stepped section removes only as much shade material as possible to reduce the width of the C-shaped channel to allow a wider range of application opportunities, without significantly weakening the strength of the cellular structure.

The stepped portion is adapted to receive the upper side of the C-shaped channel which prevents the shade from bowing upwardly as it is retracted. The track is adjacent the upper side and fits in the stepped portion without obstruction or interference with the shade. The drive mechanism is attached to the header of the shade and is free to ride along the track means to expand or retract the shade. The angled section is provided to allow the shade to be received within the C-channel when it is mounted in the window to the maximum possible engagement, and to provide strength and support to the shade so that the shade can be supported upon the leg of the C-shaped channel.

Other objects, advantages and capabilities of the present invention will become more apparent as the description proceeds, taken in conjunction with the accompanying drawings.

DETAILED DESCRIPTION OF THE PREFERRED EMBODIMENT

Figure 1:
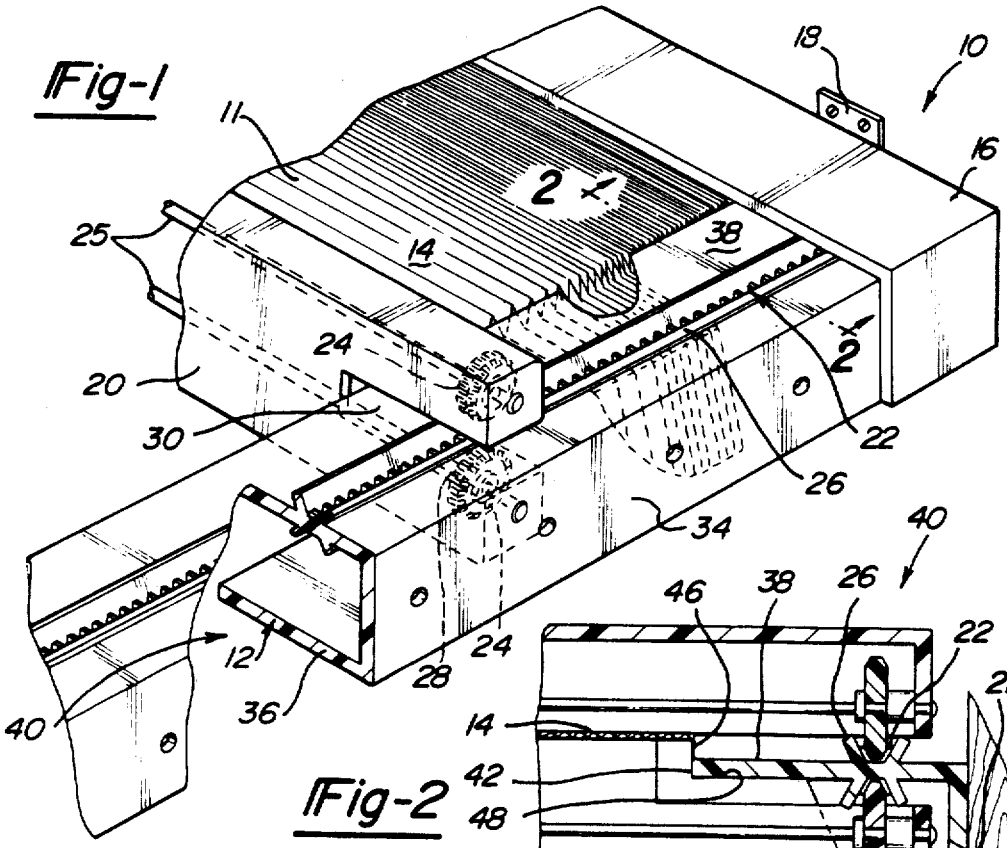
FIG. 1 is a partial perspective view of the multi-cellular shade assembly of the present invention.

With reference to FIG. 1, a shade assembly is shown generally at 10 and includes a multi cellular shade 11. FIG. 1 illustrates one side of the shade assembly 10, it should be understood that in the preferred embodiment the opposite side would be substantially identical. The shade has a front face 12 which faces the interior of a room and a rear face 14 which faces the window when installed. As illustrated, the multi-cellular shade 11 is installed in a non-vertical window such as for example, a skylight. However, it should be understood, that the improved shade of the present invention could be installed in a vertical window if desired.

With reference again to FIG. 1, the top of the shade is received within a header 16 which is in turn mounted by a mounting means 18 to the frame of the window in which the multi cellular shade 11 is installed. The bottom of shade 11 is mounted within a footer 20 which in the preferred embodiment has an electronic or manual driving means which can be respectively remotely or manually controlled. Such remotely or manually controlled driving means are available from Comfortex under the trademark Oasis and are protected by U.S. Pat. No. 4,807,686.

The motorized footer 20 includes driving wheels 24 which engage the opposite sides of a track 22 that extends outwardly from header 16. The track 22 is part of a C-shaped channel 34 which is attached to the window frame for greater stability. In the preferred embodiment, the track 22 has teeth 26 that are engaged by corresponding teeth 28 on wheels 24. Both wheels 24 are coupled to other substantially identical and uniquely corresponding wheels (not shown) by means of shafts 25 that ensure that all wheels 24 rotate in substantially identical manners. Such matched rotation assures perpendicularity between footer 20 and track 22. There is an opening or slot 30 in footer 20 which receives the track to permit the footer 20 to traverse the length of the track for extending and retracting shade 11. Slot 30 also receives top surface 38 which will be described in greater detail below.

Figure 2:
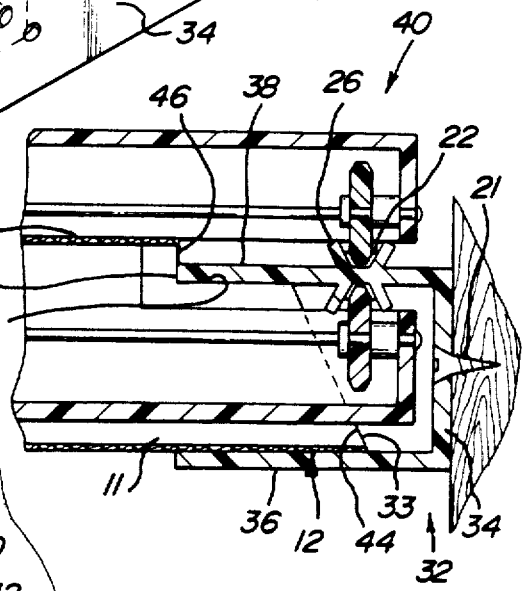
FIG. 2 is a plan view of a section of the multi cellular shade assembly of the present invention.

With reference to FIG. 2, it can be seen that the track 22 is part of a C-shaped channel 32 that encloses the side 33 of the shade 11. Channel 32 has a side wall 34 and a foot or lower flange 36 that extends under and supports shade 11. The top surface 38 extends across part of the rear face 14 to prevent the shade 11 from bowing upwardly when it is retracted. Without top surface 38, the shade 11 could bow upwardly against the window as it is being retracted.

Figure 4:
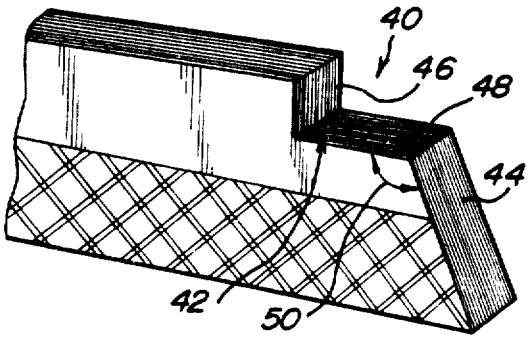
FIG. 4 is a perspective view of a section of a fully retracted multi-cellular shade configured in accordance with the claimed invention.

Side 33 of shade 11 has a cut away portion shown generally at 40. In the preferred embodiment, both sides are cut away in the same manner. This cut away portion 40 is defined by a stepped section shown generally at 42 and an angled section 44. The stepped section 42 of the preferred embodiment is defined by two substantially perpendicular planes. A perpendicular plane 46 which is formed by cutting the shade perpendicular to the rear face 14 and a parallel plane 48 which is formed by cutting the shade parallel to rear face 14. The angled section 44 is angled at an obtuse angle to parallel plane 48 and begins at the terminus of plane 48. The obtuse angle is illustrated at 50 in FIG. 4. Obtuse angle 50 allows the shade 11 to have a maximum width at front face 12. This maximum width allows the greatest amount of surface area of shade 11 to contact flange 36 thereby, allowing maximum amount of irregularity in dimensions if the window, to which channel 32 is attached and also allows the use of conveniently sized fasteners 21 to affix channel 32 to a window without interference. The preferred method of making the cut away portions is to first form the multi cellular shade and then to compress it as shown in FIG. 4. While compressed, the stepped section and the angled section can be cut into the shade ends.

Figure 3:
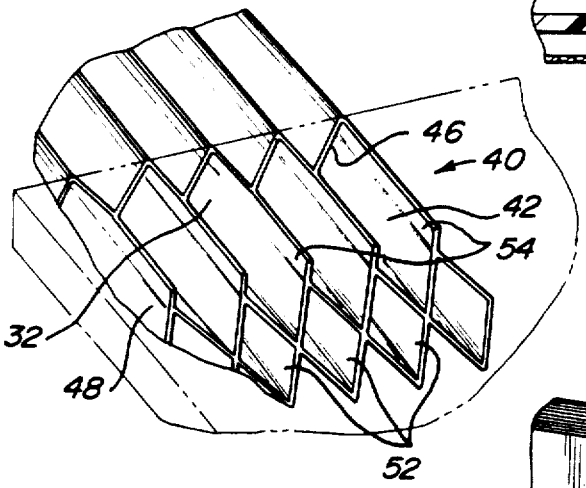
FIG. 3 is a partial perspective view of a partially expanded multi-cellular shade configured in accordance with the claimed invention.

With reference to FIG. 3, the cellular construction of the multi cellular shade of the present invention is illustrated. By cutting the stepped section 42 in the preferred way, the multi cellular construction has a full set of cells 52 supported on the foot 36 of channel 32 and partial cells 54 opening upwardly in the direction of rear face 14. This provides full cellular support to the shade along the edge of its front face. In this way, the multi cellular shade 11 can be mounted so that it is supported along the front face by foot 36. Moreover, this preferred stepped section embodiment allows for a minimization of the distance between the top and bottom flanges 36, 38 of the channel 32 without the need to cut or remove those portions of the shade material which would substantially reduce the overall material strength.

As should be apparent, the above improved shade assembly provides an automated shade assembly which can be installed in a non vertical window thereby substantially avoiding problems of binding. The C shaped channels are adapted to be mounted to the sides of a window or skylight with the header attached to the top or bottom of the skylight. This unit is adapted to be installed in a window opening by using fasteners 21 which are typically available and known to those involved in installing these types of shades. The C-shaped channel is configured so, that the footer 20 rides only upon track 22 while shade 11 rides only upon the lower leg or foot 36 of the channel. This further reduces the potential of binding for the unit. It being understood that the C-shaped channel would be of rigid construction either made of aluminum or plastic. Further, by allowing the footer 20 to ride upon the upper portion of track 22 of the channel, the shade 11 is held off of the lower leg or foot 36 until it is expanded to a point wherein it begins to sag downwardly. It being understood that the distance of this sag would only be a very small amount since the foot 36 would support the shade 11. As should be appreciated, there is very little if any binding which will occur in the retraction or expansion of the shade assembly of the present invention.

It is to be understood that the embodiment described herein is merely illustrative of the general principals of the invention. Numerous various and modifications may be made by those skilled in the art. For example, a different multi cellular shade construction could be used in place of that disclosed. Additionally, the retracting mechanism could be different and require minor modifications to the cut away portion in order to accommodate the modified retracting mechanism. Other modifications will be apparent to those of ordinary skill in the art. The present invention is not to be limited to the particular forms herein shown and described except insofar as indicated by the scope of the following claims.

What is claimed is:

1. An improved multi cellular shade adapted to be mounted within a window and to be expanded and retracted within said window, said shade having a front face and a rear face with said rear face being adjacent to said window and said front face facing the interior of a room, opposed sides, and retracting means for retracting and expanding said shade within said window, said improvement comprising:

at least one side having a recessed area, said recessed area extending longitudinally along the length of said shade and laterally across a predetermined distance, said recessed area having a width measured laterally which decreases in lateral dimension from said rear face to said front face, whereby said shade can be expanded and retracted without interference with said retracting mechanism.

2. The shade of claim 1, wherein said shade is mounted in a non vertical window.

3. The shade of claim 2, wherein said multi cellular shade includes a frame along at least the sides of said window upon which the said outer edges of said front face can be supported.

4. The shade of claim 3, wherein said frame has a C-shaped cross-section.

5. The shade of claim 1, wherein said front face of said shade is wider than said rear face of said shade.

6. The shade of claim 1, wherein said recessed area includes a stepped region that has a section generally perpendicular to said front and rear faces ending in a second section generally perpendicular to said front and rear faces, said second section ending in an inclined wall which extends to said front face.

7. The shade of claim 1, wherein said shade includes a header and a footer, said header being fixedly mounted within said window frame and said footer being free to traverse the distance of said window frame, said shade being mounted to both said header and said footer such that said shade can be expanded and retracted.

8. The shade of claim 1, wherein said retracting means includes a driving means that drives said shade between said expanded and retracted positions.

9. The shade of claim 1, further including:

a channel extending in the direction of expansion and retraction of said shade, said channel having a C-shaped cross-section which includes a lower leg extending under said shade to support said shade, a wall adjacent the side of said shade, a track means extending over said shade and a top surface extending over said recessed area of said shade; and a drive means operatively coupled to said track so as to maintain perpendicularity between said track and said footer.

10. An improved multi-cellular shade assembly adapted to be mounted within a window and adapted to be expanded and retracted within said window, said shade having a front face and a rear face with the said rear face being adjacent to said window and said front face facing the interior of a room, opposed sides, and retracting means for retracting and expanding said shade within said window, said improvement comprising:

a channel extending in the direction of expansion and retraction of said shade, said channel having at least one flange upon which said shade can be supported as said shade is retracted and expanded;

a cutaway portion on at least one of said opposed sides, said cutaway portion being defined by a stepped section that terminates in an angled section as viewed from the rear side facing the front side of a shade, said stepped section being defined by two substantially perpendicular sections, one section being generally perpendicular to the front and rear faces of the shade and a second section being generally parallel to said faces, said second section being adapted to minimize the distance between the top and bottom of said channel, said second section also terminating in said angled portion, said angled portion being at a generally obtuse angle to said second wall thereby, maximizing the surface area of said shade contacting said channel.

11. The shade assembly of claim 9, wherein said shade is mounted within a non-vertical window, said retracting means being mounted with the said stepped region and concealed by said front face of said shade.

12. The shade assembly of claim 10, wherein said stepped region extends along the length of said shade.

13. The shade assembly of claim 10, wherein said channel further includes:

a wall adjacent the side of said shade, track means extending over said shade and a top surface extending over said recessed area of said shade;

a drive means operatively coupled to said track and connected to said shade for expanding and retracting said shade.

14. The shade assembly of claim 10, further including an electric drive means operatively coupled to a track extending along said shade in the direction of expansion and contraction, said tracking received within said stepped section.

15. The shade assembly of claim 10, wherein said channel has a C shaped cross-section which includes a lower leg extending under said shade to support said shade, a wall adjacent the side of said shade, a track means coupled to said C-shaped cross-section and a top surface extending over said recessed area of said shade to prevent said shade from bowing upwardly during retraction;

a drive means operatively coupled to said track and coupled to said shade for expanding and retracting said shade;

said drive means being supported by said track of said C-shaped channel.

* * * * *